US008794623B2

(12) United States Patent
Matsumoto

(10) Patent No.: US 8,794,623 B2
(45) Date of Patent: Aug. 5, 2014

(54) IMAGING APPARATUS

(71) Applicant: Canon Kabushiki Kaisha, Tokyo (JP)

(72) Inventor: Toshiya Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/019,977

(22) Filed: Sep. 6, 2013

(65) Prior Publication Data

US 2014/0070482 A1 Mar. 13, 2014

(30) Foreign Application Priority Data

Sep. 7, 2012 (JP) ..... 2012-196870

(51) Int. Cl.
*B65H 31/20* (2006.01)
*B65H 1/04* (2006.01)

(52) U.S. Cl.
CPC ..... *B65H 1/04* (2013.01)
USPC ..... 271/223; 271/171

(58) Field of Classification Search
USPC ..... 271/9.09, 162, 164, 171, 223; 400/680
See application file for complete search history.

(56) References Cited

U.S. PATENT DOCUMENTS 5,241,353 A * 8/1993 Maeshima et al. ..... 399/405
2011/0001284 A1* 1/2011 Ohtsuki ..... 271/162

FOREIGN PATENT DOCUMENTS

JP 2004-256232 A 9/2004

* cited by examiner

*Primary Examiner* — Michael McCullough
(74) *Attorney, Agent, or Firm* — Canon U.S.A., Inc., IP Division

(57) ABSTRACT

An imaging apparatus includes a door configured to be openable and closable with respect to a housing and to support a sheet, an extender configured to be stored in the door and to support a sheet, and a mechanism configured to rotate the extender in conjunction with opening and closing the door. The extender rotates and protrudes from the door when the door is opened, and the extender rotates and is stored in the door when the door is closed.

16 Claims, 19 Drawing Sheets

IMAGING APPARATUS

BACKGROUND

1. Field

Aspects of the present invention generally relate to an apparatus for performing imaging operations such as printing and image reading with respect to a sheet.

2. Description of the Related Art

According to an apparatus discussed in Japanese Patent Application Laid-Open No. 2004-256232, a discharge tray on which sheets are discharged is configured to open and close with respect to the apparatus and save a space of the apparatus since the discharge tray is closed when it is not used. The discharge tray includes a built-in auxiliary stacker and a biasing mechanism which causes the auxiliary stacker to protrude by sliding and moving to a front side when the discharge tray is opened. When the auxiliary stacker protrudes, a front side of the discharge tray is extended and a sheet supporting area is enlarged so that a large size sheet can be supported.

However, the auxiliary stacker once protruded does not automatically return to an original position in the apparatus discussed in Japanese Patent Application Laid-Open No. 2004-256232. When the discharge tray is closed after printing, a user needs to close the discharge tray by one hand while holding the auxiliary stacker in a retracted state against a biasing force of the biasing mechanism by the other one hand. The user needs to handle complicated operations with both hands, and it is far from user friendly.

In addition, in a case of the sliding type auxiliary stacker for protruding to the front side as in the apparatus discussed in Japanese Patent Application Laid-Open No. 2004-256232, an extendable length is limited by a size in a height direction of the opening/closing discharge tray. According to Japanese Patent Application Laid-Open No. 2004-256232, the automatically protruding auxiliary stacker further includes a second built-in auxiliary stacker, however, an extendable length is limited and it is difficult to obtain a rigidity to stack a lot of sheets thereon. Looked at from another perspective, in order to increase the size of the auxiliary stacker, the size of the discharge tray including the auxiliary stacker in the height direction needs to be increased, which means an increase in the size of the entire apparatus.

SUMMARY

The present disclosure is generally directed to solving at least one of the above described issues. More specifically, the present disclosure is directed to improvement of user operability and downsizing of an imaging apparatus including an openable and closable cover unit for supporting a sheet.

According to an aspect of the present invention, an imaging apparatus includes a housing within which an imaging unit is installed, a door configured to be openable with respect to the housing and to support a sheet used by the imaging unit, an extender configured to be stored in the door and to support a sheet, and a mechanism configured to rotate the extender in conjunction with opening and closing the door, wherein the extender rotates and protrudes from the door when the door is opened and the extender rotates and is stored in the door when the door is closed.

Further features of the present invention will become apparent from the following description of exemplary embodiments with reference to the attached drawings.

DESCRIPTION OF THE EMBODIMENTS

An inkjet printing apparatus according to an exemplary embodiment is described below. A printing apparatus for printing an image on a sheet (outputting an image) is described as an example below, however, exemplary embodiments are not limited to the printing apparatus and are applicable to an image reading apparatus for reading an image on a sheet (inputting an image). In the present specification, apparatuses, such as a printing apparatus and an image reading apparatus, which perform imaging operations (input/output of an image) are collectively referred to as imaging apparatuses.

Figure 1A:
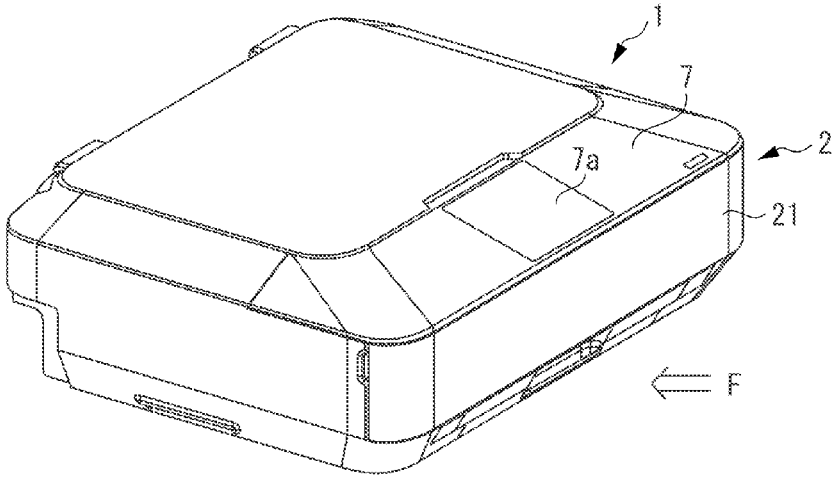
FIGS. 1A and 1B are perspective views of an outer appearance of a printing apparatus according to an exemplary embodiment.
Figure 1B:
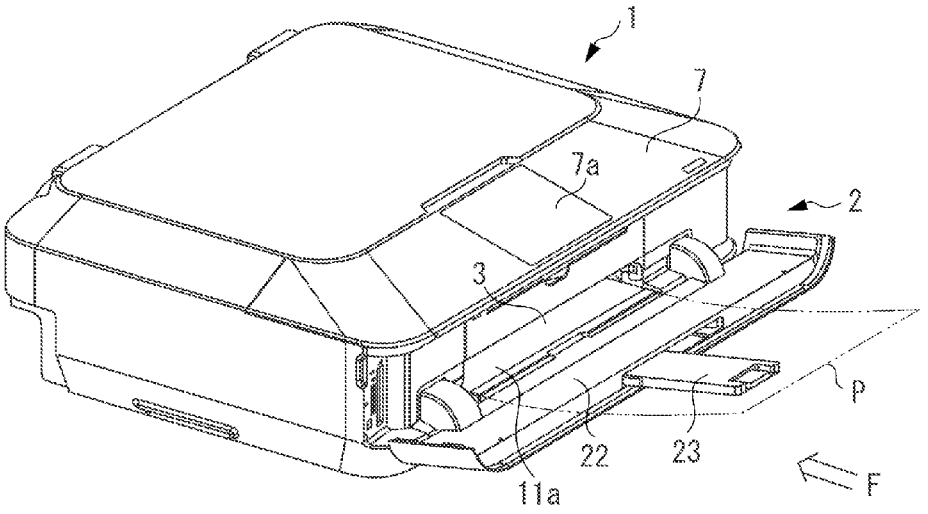
Figure 2A:
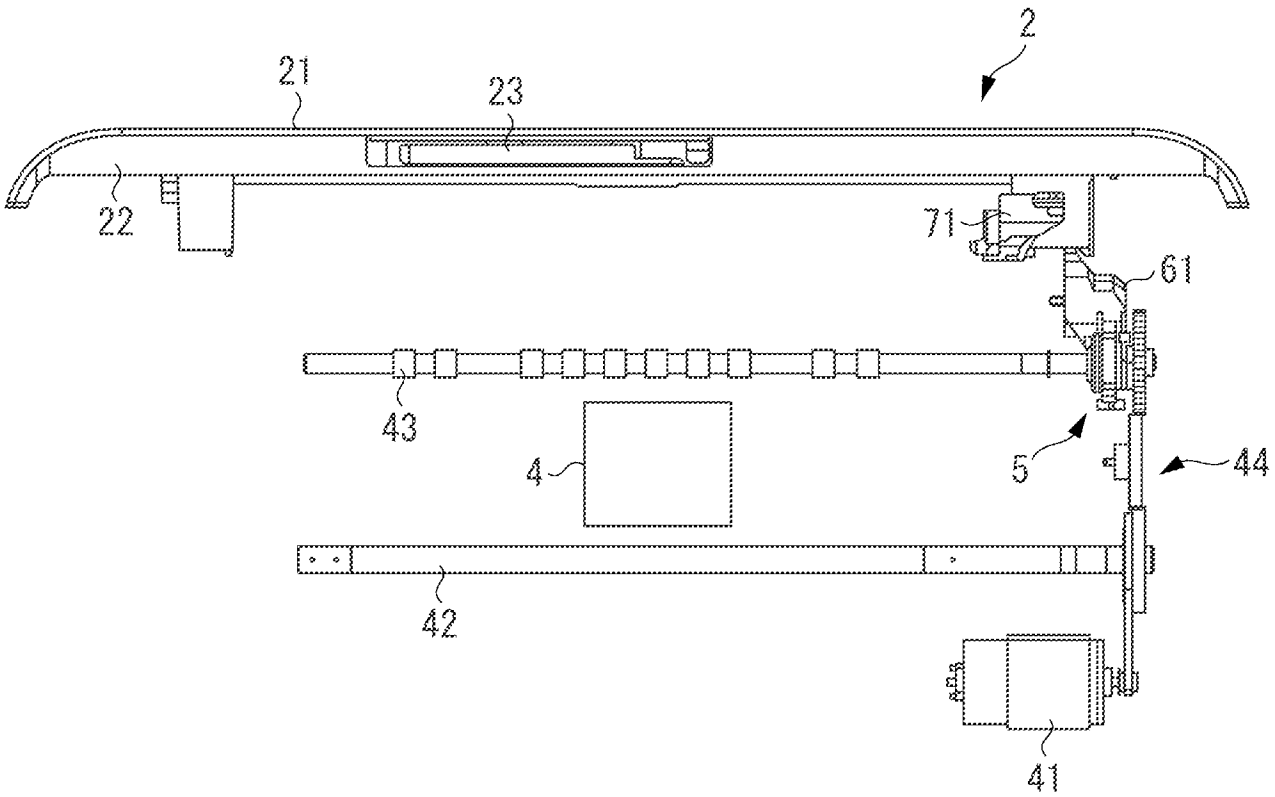
FIGS. 2A and 2B are plain views illustrating a main portion of a cover unit.
Figure 2B:
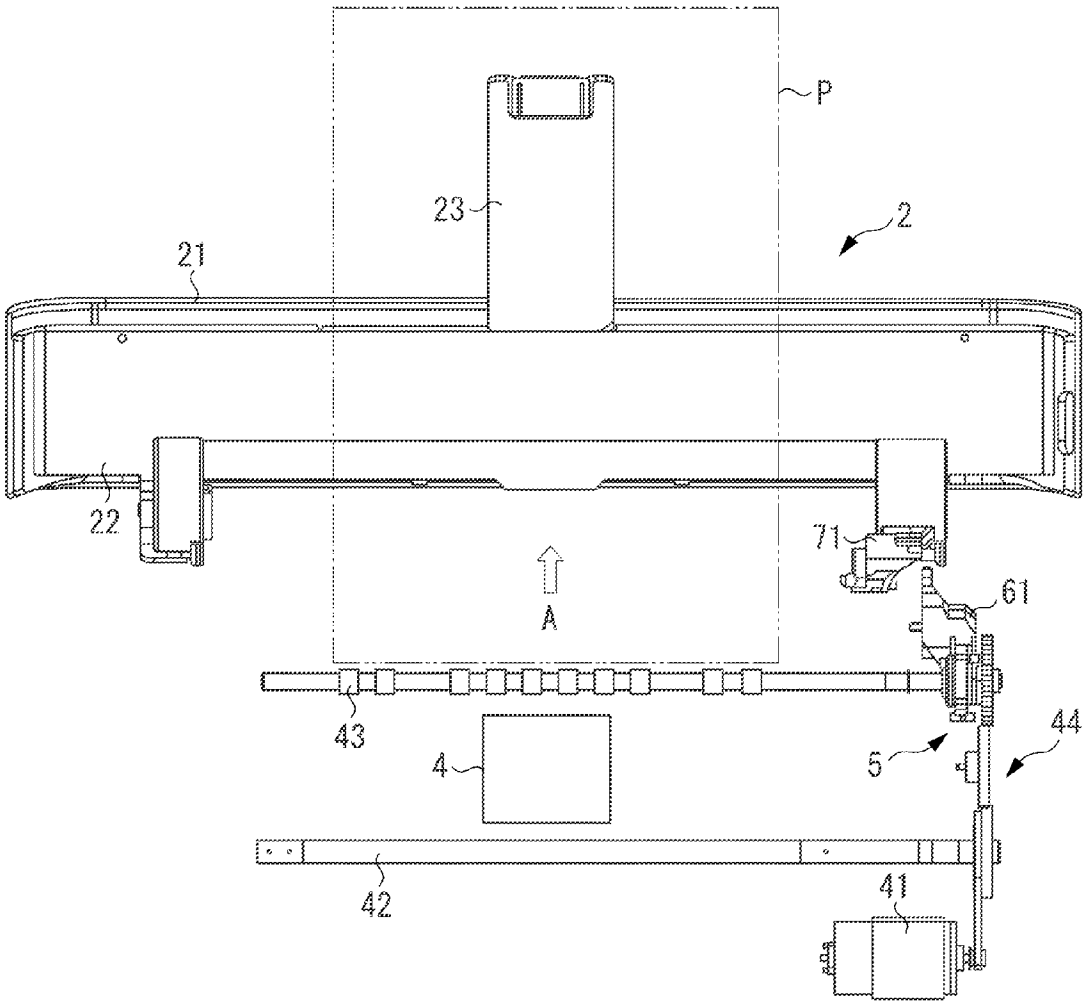
Figure 3A:
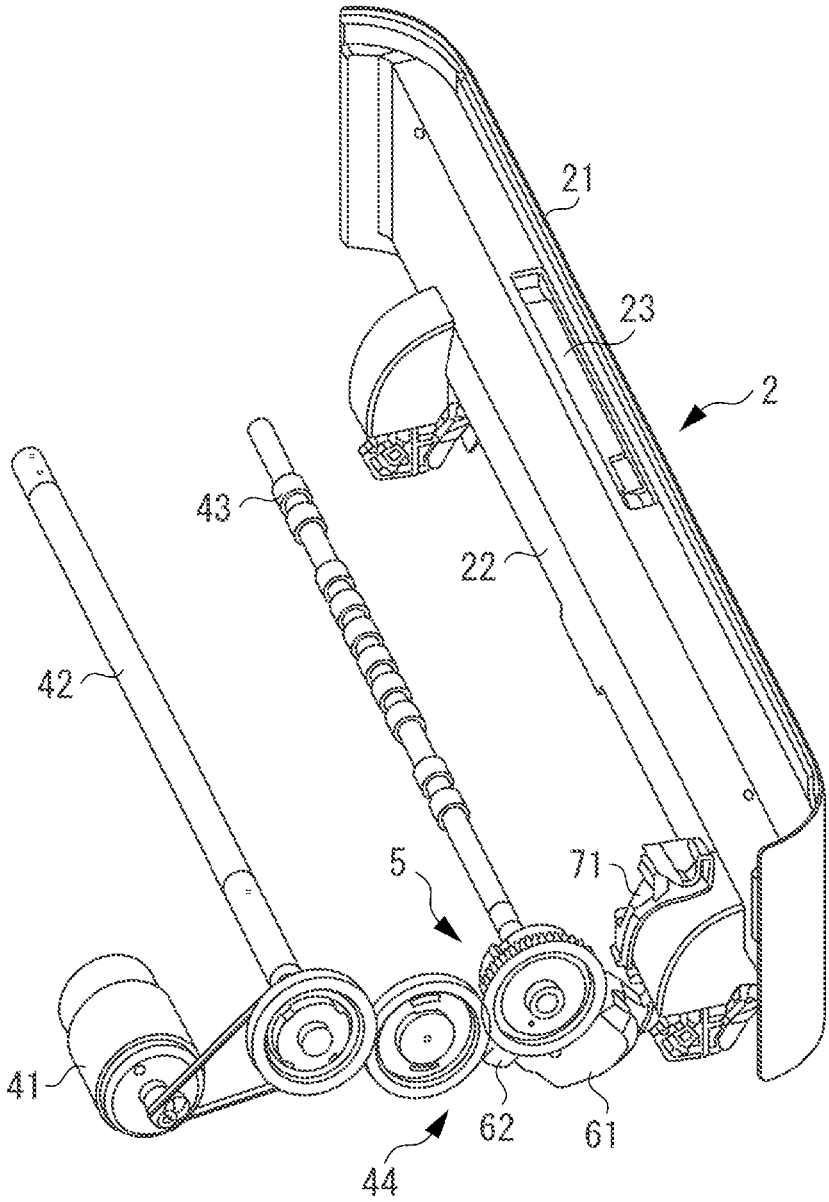
FIGS. 3A and 3B are perspective views of the main portion in FIGS. 2A and 2B.
Figure 3B:
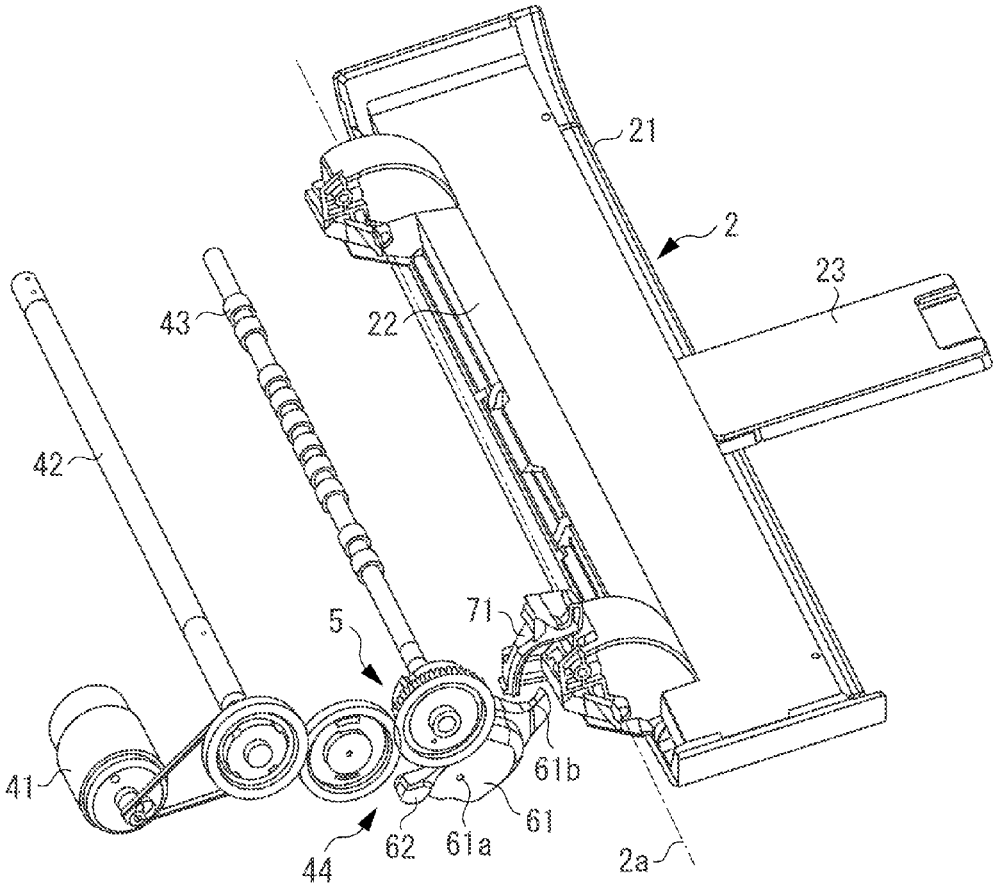

FIGS. 1A and 1B are perspective views of an outer appearance of the printing apparatus. The printing apparatus includes a housing 1 in which an ink-jet printing unit is installed and a cover unit 2 which forms apart of a side surface of the housing 1 and can open and close an opening 3 (i.e., a sheet discharge port) of the housing 1. FIG. 1A illustrates a state when the cover unit 2 is closed, and FIG. 1B illustrates a state when the cover unit 2 is opened. At the time of use, a user faces the printing apparatus from a direction indicated by an arrow F. In the present specification, an apparatus installed in a usage environment is defined to have a front side and a rear side along the arrow F direction that the user facing, and an upper side and a lower side along with the direction of gravitational force.

The cover unit 2 serves as a sheet stacking unit for stacking and supporting a sheet P to be used in a printing unit (a sheet to be used for printing or a sheet discharged from the printing unit) on its upper surface (a surface of an inner cover 22 described below) when the cover unit 2 is in the open state.

The cover unit 2 which is in a vertical orientation and covers the opening 3 when it is closed is configured to open toward the front side of the apparatus (i.e., a direction toward a user operating the apparatus) around an opening/closing shaft of two hinge mechanisms provided to right and left sides of a lower end (a rotational angle is approximately 80 degrees). As described below, the cover unit 2 includes a mechanism in which an extension tray 23 as an extender which is stored in the cover unit 2 rotates and protrudes to the front side of the apparatus when the cover unit 2 is opened. The housing 1 also includes a supporting unit 11*a*. A sheet discharged from the opening 3 is supported on a sheet stacking surface (a supporting surface) including the supporting unit 11*a*, the surface of the cover unit 2, and an upper surface of the extension tray 23, and thus a plurality of sheets is stacked thereon. As described above, the extension tray 23 rotates and protrudes to the front side of the apparatus while maintaining itself parallel to the sheet stacking surface.

An operation unit 7 including a display device 7*a*, an input button, and the like is provided above the cover unit 2. The operation unit 7 is configured to open and close in vertical directions with respect to the housing 1 by a parallel link mechanism for maintenance or the like. In FIGS. 1A and 1B, the operation unit 7 is closed.

FIGS. 2A and 2B and FIGS. 3A and 3B are plan views and perspective views respectively, illustrating a configuration of a main portion centering on the cover unit 2 which is provided on the front side of the printing apparatus. Inside the apparatus, a motor 41, a conveyance roller 42, and a discharge roller 43 are disposed, and a driving force of the motor 41 is transmitted to the conveyance roller 42 and the discharge roller 43 via a transmission gear 44, thus these rollers can rotate synchronously. The conveyance roller 42 and the discharge roller 43 respectively form a roller pair with a pinch roller to for pinching a sheet P. In a printing operation, a sheet is conveyed from the conveyance roller 42 to the discharge roller 43, and discharged by the discharge roller 43 onto the cover unit 2 (a direction indicated by an arrow A in FIG. 2B). In the present specification, rotation of the motor and the respective rollers in the printing operation is defined as normal rotation, and rotation in an opposite direction thereto is defined as reverse rotation.

A printing unit 4 including an ink-jet printing head is provided between the conveyance roller 42 and the discharge roller 43, and the printing unit 4 prints an image on a sheet P. The printing unit 4 forms an image in serial printing or line printing. In the case of serial printing, the printing unit 4 reciprocates the print head by a carriage in right and left directions in FIGS. 2A and 2B, and alternately performs image printing in one band and a step feed of the sheet. In the case of line printing, the printing unit 4 forms an image on a sheet by a line print head which is fixed, while moving the sheet. Not limited to the ink-jet printing method, the printing unit 4 may employ other printing methods. The housing 1 includes a recovery unit for maintaining the performance of the print head therein. The recovery unit is driven by the motor 41 and performs maintenance such as ink suction and wiping on ink nozzles of the print head.

As described above, the present disclosure is applicable not only to the printing apparatus but also a wide range of imaging apparatuses. Therefore, the printing unit 4 can be replaced to a reading unit including an image sensor for reading an image on a sheet. In the present specification, units, such as a printing unit and a reading unit, for inputting and outputting images are collectively referred to as imaging units.

Figure 4A:
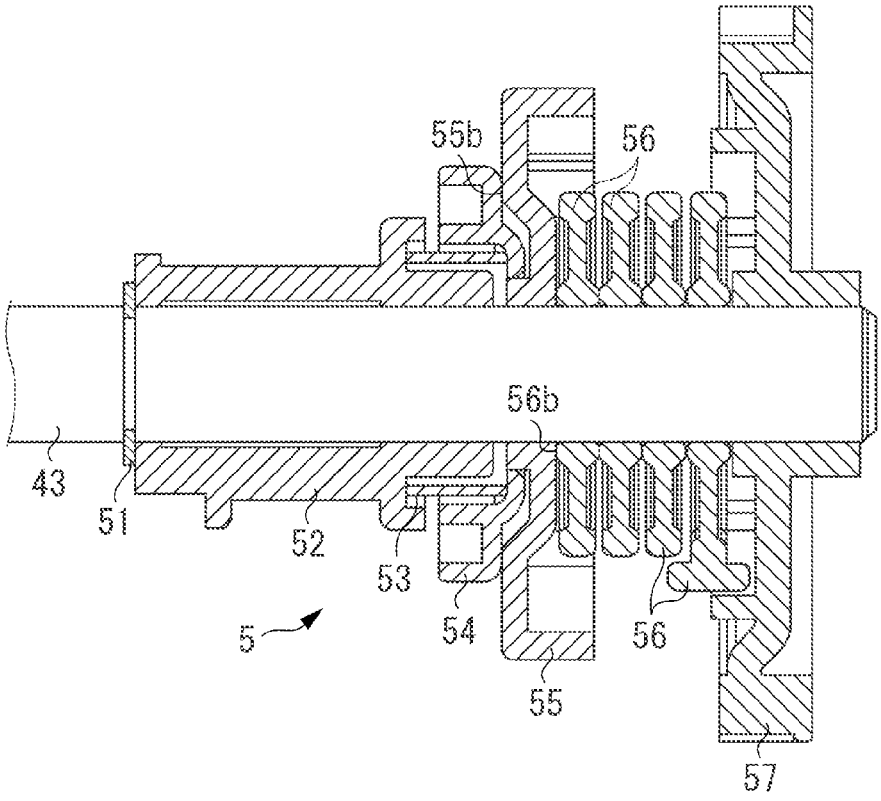
FIGS. 4A and 4B illustrate a structure of a delay mechanism.
Figure 4B:
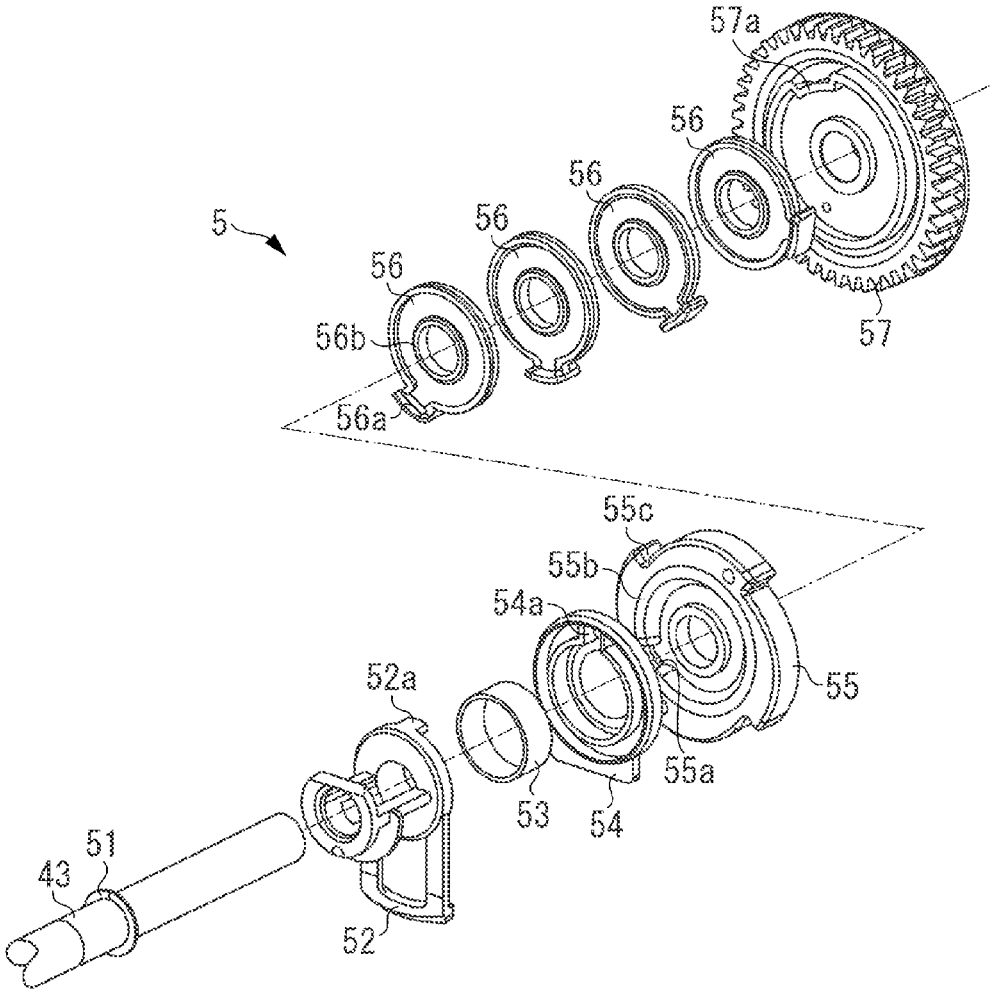

At the end of the discharge roller 43, there is provided a delay mechanism 5 for mechanically delaying transmission of the driving force (i.e., a driving trigger) from the motor 41 at a predetermined rotation amount. FIGS. 4A and 4B are schematic views illustrate a configuration of the delay mechanism 5, and FIG. 4A is a cross-sectional view and FIG. 4B is an exploded perspective view.

A driving gear 57 is fixed at one end of a rotational shaft of the discharge roller 43, and the driving force of the motor 41 is transmitted to the driving gear 57. Inside the driving gear 57, four delay transmission rings 56 and one trigger cam 55 are rotatably installed with respect to the rotational shaft of the discharge roller 43. A rotation regulating portion 57*a* inside the driving gear 57, a rotation regulating unit 56*a* of a delay transmission ring 56, and a rotation regulating unit 55*a* of a trigger cam 55 are located on the same radius and regulate the rotation operations of respective neighboring components. Each of the rotation regulating units of the above-described three units has a length about one-tenth of one revolution thereof and can rotate in a range of eight-tenths of the revolution with respect to the neighboring component. In other words, the driving of the driving gear 57 is transmitted to the delay transmission ring 56 inscribed therein by being delayed by up to eight-tenths of the revolution, and thus the rotation is transmitted to the trigger cam 55 which is the fifth component by being delayed up to 0.8*5=4.0 revolutions.

Inside the trigger cam 55, a friction ring 54, a compression spring 53, a bearing 52, and a slit ring 51 are mounted in this order from the outside. The bearing 52 is fixed based on the apparatus main body and supports the rotational shaft of the discharge roller 43 in a rotatable state. A protrusion 52*a* of the bearing 52 fits into a groove portion 54*a* of the friction ring 54, so that the protrusion 52*a* regulates the friction ring 54 not to rotate with respect to the apparatus main body. The slit ring 51 which is disposed in the innermost side fits into a groove carved in the rotational shaft of the discharge roller 43, and thus is regulated a movement in an axial direction with respect to the discharge roller 43. The compression spring 53 applies a force to a component sandwiched between the slit ring 51 and the driving gear 57 in the axial direction. Accordingly, the respective components overlap with each other in series are compressed by equal force. In addition, a sliding portion 55*b* of the trigger cam 55 and a sliding portion 56*b* of the delay transmission ring 56 are configured to abut on respective adjacent components at that time. A radius of the sliding portion 55*b* of the trigger cam 55 is approximately twice the radius of the sliding portion 56*b* of the delay transmission ring 56. In an outer periphery of the trigger cam 55, convex cam portions are formed for four cycles in the one revolution, and four step surfaces 55*c* are provided. The friction ring 54, the trigger cam 55, the delay transmission ring 56, and the driving gear 57 are made of the same material.

According to the above-described configuration, a brake force of the trigger cam 55 can be always greater than a brake force of the delay transmission ring 56. Therefore, if the driving gear 57 rotates, the trigger cam 55 is not driven only by the frictional force regardless of the normal rotation or the reverse rotation. The trigger cam 55 is driven to rotate only when all of the rotation regulating units contact one another and press to rotate the trigger cam 55. Accordingly, the trigger cam 55 is driven and rotated when the driving gear 57 is rotated more than four revolutions which corresponds the maximum delay amount regardless of the normal rotation or the reverse rotation. When the trigger cam 55 is in the normal rotation state, a delay storage amount is zero, whereas when the trigger cam 55 is in the reverse rotation state, the delay storage amount is the maximum (i.e., four revolutions). The delay storage amount of the delay mechanism 5 can be controlled by a rotational direction and a rotation amount of the motor 41. As described above, the delay mechanism 5 is a mechanism which transmits rotation of a roller for conveying a sheet when it is reversely rotated as a trigger operation for opening the cover unit 2, and is characterized in that the delay mechanism 5 delays the transmission of the trigger operation in a predetermined range.

As illustrated in FIGS. 2A and 2B, and FIGS. 3A and 3B, a trigger lever 61 is provided below the delay mechanism 5. In addition, a sub lever 62 is rotatably provided in a hole portion 61*a* at a backward portion (in the rear side of the apparatus) of the trigger lever 61. Each of the sub lever 62 and the trigger lever 61 is configured so that the backward portion thereof is weighed down with its self weight.

An arm portion 61*b* provided at a forward portion (in the front side of the apparatus) of the trigger lever 61 is engaged with a part of the hinge mechanism of the cover unit 2, and the arm portion 61*b* is pressed in the downward direction when the cover unit 2 is closed. This depressing force rotates the trigger lever 61, so that the sub lever 62 at the back is elevated. At a connecting position where the sub lever 62 is elevated, an upper end portion of the sub lever 62 abuts on an outer peripheral cam surface of the trigger cam 55 and leans thereon by the self weight of the sub lever 62. In contrast, at a retracting position when the cover unit 2 is opened and the trigger lever 61 and the sub lever 62 are weighed down to the back with the self weights, if the trigger cam 55 rotates, the trigger cam 55 does not contact with the sub lever 62. When the trigger cam 55 reversely rotates at the connecting position where the sub lever 62 is elevated, the upper end of the sub lever 62 follows the outer peripheral cam surface of the trigger cam 55 and makes an escape by rotating around the hole portion 61*a* of the trigger lever 61, so that the trigger lever 61 does not operate. On the other hand, when the trigger cam 55 normally rotates at the connecting position where the sub lever 62 is elevated, the step surfaces 55*c* of the trigger cam 55 presses the upper end of the sub lever 62, the trigger lever 61 rotates, and the arm portion 61*b* pushes the cover unit 2 open.

Figure 5A:
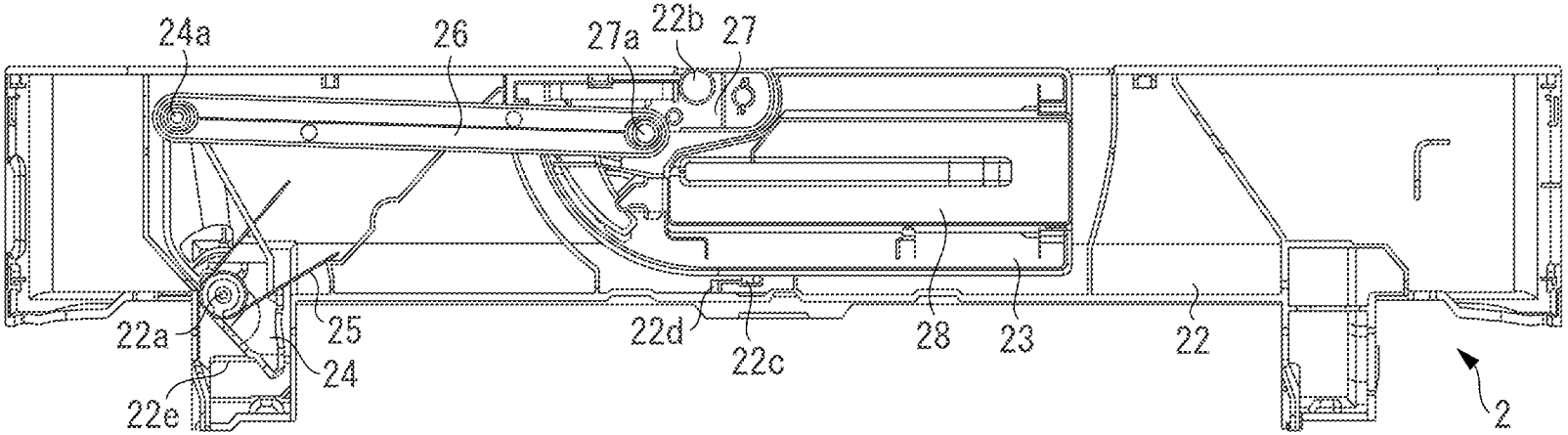
FIGS. 5A and 5B are plan views illustrating a structure of an interlocking mechanism in the cover unit.
Figure 5B:
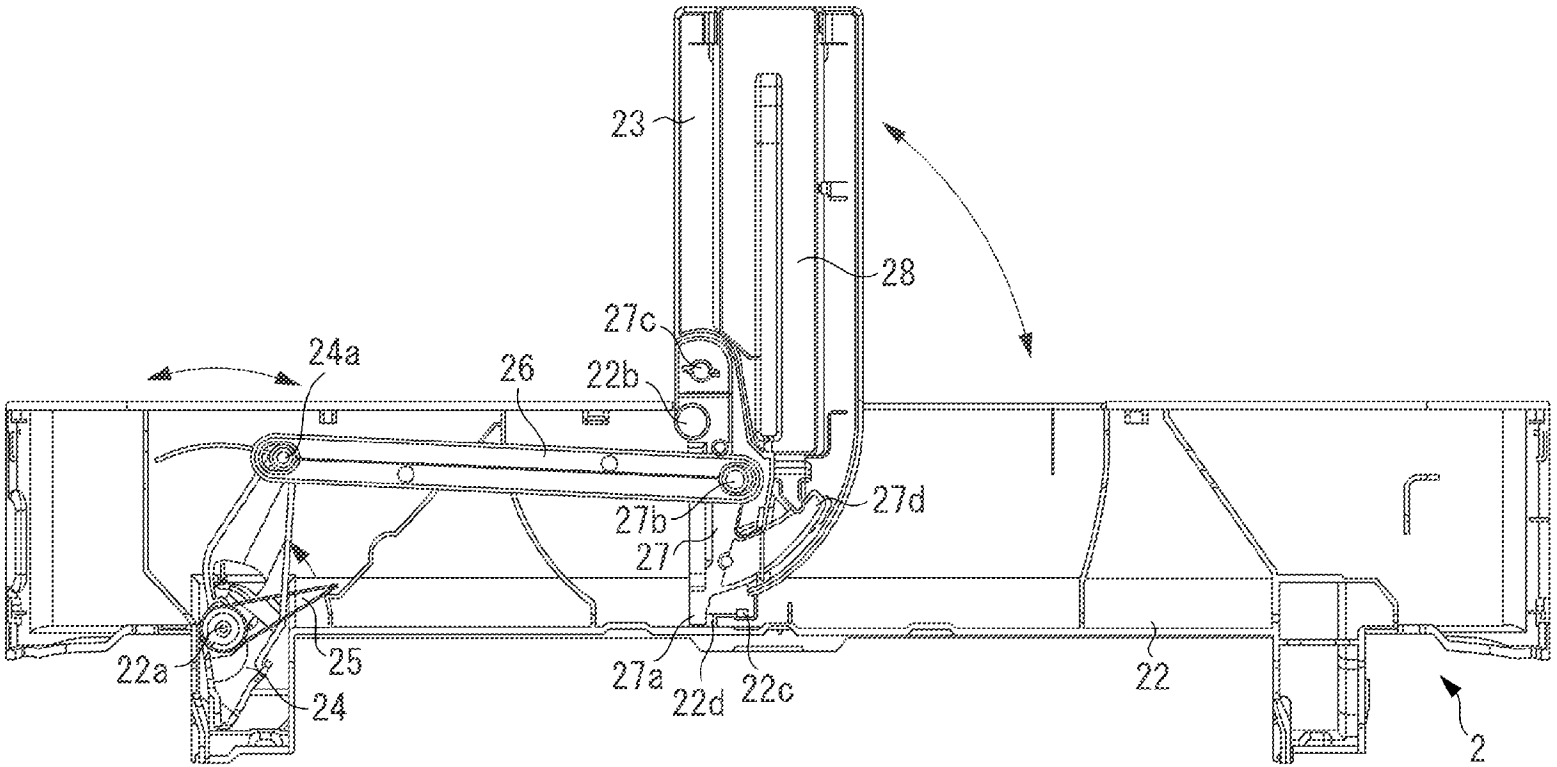
Figure 6A:
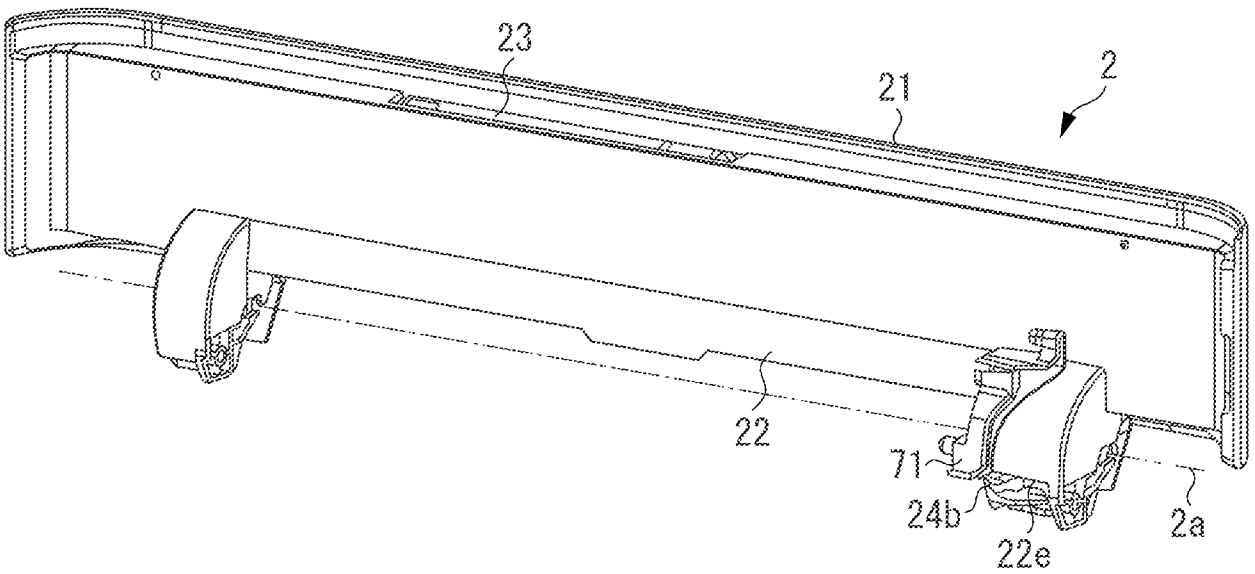
FIGS. 6A to 6C are perspective views illustrating a connecting portion of the cover unit and a main body of the apparatus.
Figure 6B:
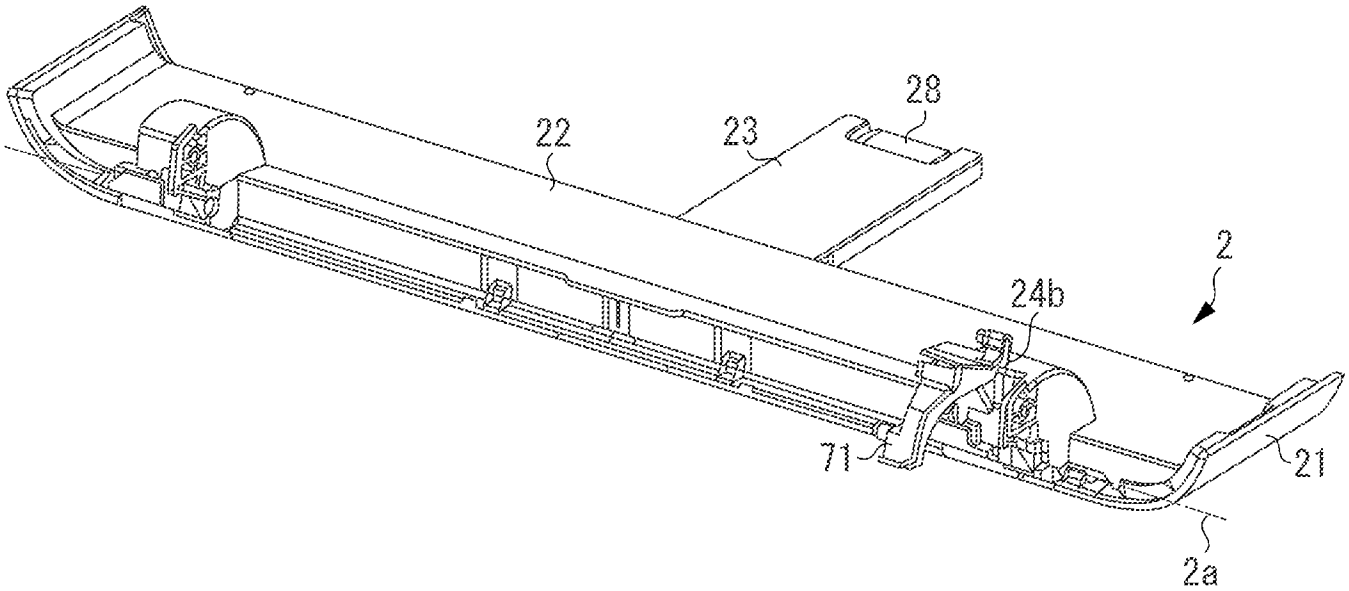
Figure 6C:
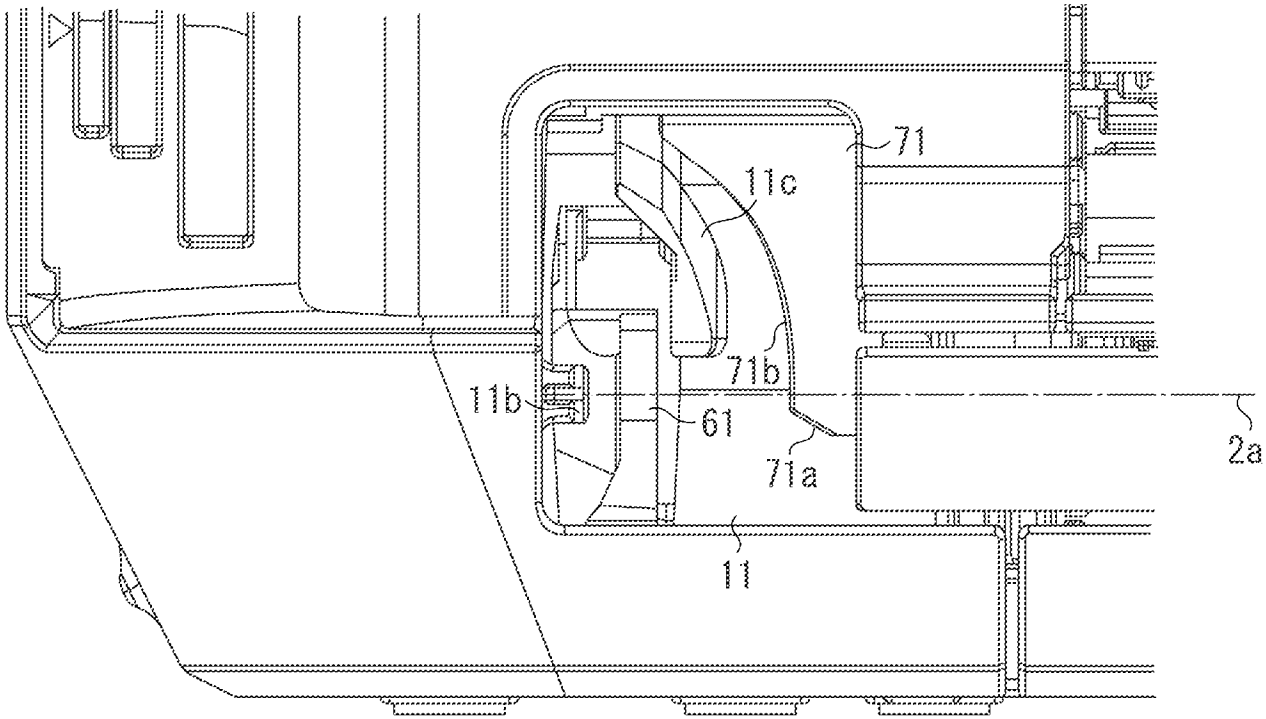

Next, the interlocking mechanism for rotating the extension tray 23 in conjunction with open and close of the cover unit 2 is described below. FIGS. 5A and 5B are plan views illustrating a configuration of the interlocking mechanism installed within the cover unit. FIGS. 6A to 6C are perspective views illustrating a configuration of the connecting portion of the cover unit and the apparatus main body. FIGS. 5A and 6A illustrate a state when the cover unit 2 is closed. FIGS. 5B and 6B illustrate a state when the cover unit 2 is opened. FIG. 6C is a configuration diagram of a left lower portion of the apparatus main body seen from the front in which the cover unit 2 is omitted.

The interlocking mechanism installed within the cover unit 2 includes an front door 21, the inner cover 22, the extension tray 23, a connecting lever 24, a torsion coil spring 25, a connecting arm 26, and an extension tray base 27. The front door 21 forms an outer appearance surface (a front surface facing to a user) of the printing apparatus when the cover unit 2 is closed. The inner cover 22 forms the sheet stacking surface (the supporting surface) on which a sheet is discharged when the cover unit 2 is opened. The front door 21 and the inner cover 22 are integrally bonded with each other to form an outer shell of the cover unit 2.

The inner cover 22 includes two hinge holes on an opening/closing shaft 2*a* held by the hinge mechanisms on the right and left sides the cover unit 2, and is rotatably supported by a shaft member 11*b* provided to a lower frame of the housing. A hole end portion 22*e* of the inner cover 22 is positioned in the rear of the opening/closing shaft 2*a* when the cover unit 2 is closed, and serves as an engagement portion for engaging with the arm portion 61*b* in front of the trigger lever 61. Inside the inner cover 22, a shaft member 22*a* and a shaft member 22*b* are provided. The shaft member 22*a* is disposed near the left hinge, and the shaft member 22*b* is disposed near the center in the sheet width direction and near a cover end portion on the downstream in the sheet conveying direction. Both of the shaft members are perpendicular to the sheet stacking surface. The extension tray 23 is supported by a shaft member 27*b* of the extension tray base 27 and engaged with a hook portion 27*d* of the extension tray base 27, thus the extension tray 23 is integrated with the extension tray base 27. In a normal state in which the hook portion 27*d* is engaged, the extension tray 23 and the extension tray base 27 are rotated, as an integrated unit, approximately 90 degrees around the shaft member 22*b* in conjunction with open or close of the cover unit 2. At the time of rotation, the extension tray 23 rotates while maintaining itself parallel to the sheet stacking surface, in other words, rotates in a plane parallel to the sheet stacking surface like a clasp knife. The extension tray 23 includes a torque limiting mechanism which releases a force by disengaging the engagement with the hook portion 27*d* when an excessive force is applied, which is described below.

The extension tray base 27 is rotatably supported by the shaft member 22*b*, and is rotatable between a storage orientation (FIG. 5A) and a protruded orientation (FIG. 5B). In the storage orientation, the integrated extension tray 23 and extension tray base 27 is completely stored in the box-like outer shell of the cover unit 2. At this time, the side surface of the extension tray 23 abuts on a regulating portion 22*c* provided to the inner cover 22. On the other hand, in the protruded orientation, the integrated extension tray 23 and extension tray base 27 protrudes forward from the sheet stacking surface of the inner cover 22 to extend an area for supporting a sheet. At this time, an end portion 27*a* of the extension tray base 27 abuts on a regulating portion 22*d* provided to the inner cover 22.

The extension tray 23 further incorporates a sub extension tray 28 which can be slid and extended. A user can optionally pull out the sub extension tray 28 by hand. Usually, the sub extension tray 28 is not necessary to be pulled out, and is to be pulled out only when a special long sheet is used in printing so as to improve the stacking property thereof. The sub extension tray 28 may remain in a pulled out state, or the extension tray 23 may be configured to be stored in the cover unit 2.

The connecting lever 24 is rotatably supported by the shaft member 22*a*, and is rotatable between the storage orientation (FIG. 5A) and the protruded orientation (FIG. 5B). Both ends of the connecting arm 26 are rotatably supported by a shaft member 24*a* near the leading edge of the connecting lever 24 and the shaft member 27*b* of the extension tray base 27, respectively, to interlock these two components. Two shaft holes at the both ends of the connecting lever 24 which are engaged with the shaft members have ellipse shapes which are slightly longer in the longitudinal directions of the respective levers to have backlashes intentionally. Accordingly, the connecting lever 24 and the extension tray base 27 interlock with each other with a slight delay. In other words, a delay mechanism is implemented in which the intentional backlashes of the engagement portions act as allowances, and the movement of the connecting lever 24 is transmitted to the extension tray base 27 with a delay. The backlash may be given any one of these two shaft members. The torsion coil spring 25 is provided on the shaft of the connecting lever 24 and applies a force to the rotational direction to which the connecting lever 24 is stored with respect to the inner cover 22. By this applied force, the extension tray base 27 and the extension tray 23 which are interlocked with each other via the connecting arm 26 are urged to the storage orientation. The torsion coil spring 25 is an example of an urging member, and the urging member is not limited to this. Other elastic members having elasticity may be used for applying a force.

As illustrated in FIG. 6C, when the apparatus main body is seen from the front side by removing the cover unit 2, a first control cam 71 is firmly fixed inside a hole at the left lower front. The first control cam 71 includes cam surfaces 71*a* and 71*b*, and the cam surfaces 71*a* and 71*b* are positioned on a curved surface equally distanced from the opening/closing shaft 2*a*. According to the open and close of the cover unit 2, an end portion 24*b* of the connecting lever 24 slides on the cam surfaces 71*a* and 71*b*, and the connecting lever 24 is rotated. A rotation operation of the connecting lever 24 is transmitted to the extension tray base 27 via the connecting arm 26, and becomes a rotation operation of the extension tray 23 integrated to the extension tray base 27. When the cover unit 2 is in the closed state, the extension tray 23 is at the storage orientation (FIG. 6A), and when the cover unit 2 is in the open state, the extension tray 23 is at the protruded orientation (FIG. 6B).

At that time, the connecting lever 24 applies a force to the first control cam 71 by the urging force of the torsion coil spring 25. Since the first control cam 71 is firmly fixed to the apparatus main body, an urging reaction force acts on the cover unit 2. On the cam surfaces 71*a* and 71*b* on which the end portion 24*b* of the connecting lever 24 abuts, as the degree of incline is large and a component force of the urging reaction force is large in a circumferential direction, then a moment in a closing direction acts on the cover unit 2 will be large. When the cover unit 2 is in the closed state, the end portion 24*b* of the connecting lever 24 abuts on the cam surfaces 71*a* with the larger degree of incline, and a relatively large moment in the closing direction acts on the cover unit 2. When the cover unit 2 is shifted to the open state, first, a relatively large moment in the closing direction acts on the cover unit 2 until the end portion 24*b* gets over the cam surfaces 71*a*. At the beginning of the cam surfaces 71*b*, once the moment will be substantially null, and then, the moment in the opening direction gradually increases as the cover unit 2 opens.

When the end portion 24*b* of the connecting lever 24 abuts on the cam surfaces 71*a* with the larger degree of incline, a rotation amount of the connecting lever 24 with respect to the change in the orientation of the cover unit 2 is large. In other words, when the cover unit 2 starts opening from the closed state, movement of the extension tray 23 is large. At that time, due to the above-described backlash in the support of the connecting arm 26, the extension tray 23 starts moving in conjunction with the start of opening of the cover unit 2 with a predetermined delay. Thus, although the operation unit is positioned immediately above the cover unit 2 in the closed state (see FIGS. 1A and 1B), the extension tray 23 protruding from the cover unit 2 which starts moving never interferes with the operation unit.

In addition, the moment of its self-weight acts on the cover unit 2. Regarding the self-weight moment, the moment in the opening direction (the downward direction of gravitational force) becomes larger as the position of center of gravity of the cover unit 2 being near to the front side with respect to the opening/closing shaft 2*a*. When the cover unit 2 is in the closed state, a relatively small self-weight moment in the closing direction acts on the cover unit 2. When the cover unit 2 is shifted to the open state, the self-weight moment once will be substantially null, and then, the self-weight moment in the opening direction gradually increases as the cover unit 2 opens. As a result of composition of the moment of the reaction force of the urging by the torsion coil spring 25 and the self-weight moment, the operation of the cover unit 2 is described as follows.

When the cover unit 2 is closed near the closed state, a force for automatically bringing the cover unit 2 to the closing direction is applied, so that the closed state is maintained. On the contrary, when the cover unit 2 is opened more than a predetermined angle, the cover unit 2 is opened to the open state while the momentum in the opening direction is relieved by the urging force of the torsion coil spring 25, and the open state is maintained while abutting on an abutting portion. Immediately before the cover unit 2 is completely opened, the urging force of the torsion coil spring 25 (a brake force) reduces the momentum for opening the cover unit 2. In other words, the torsion coil spring 25 which is an elastic member for applying a force in one direction to the connecting lever 24 and the cam shape of the first control cam 71 function as a brake mechanism which applies a brake force for reducing an impact at the moment when the cover unit 2 is completely opened. By providing this brake mechanism, an impact noise when the cover unit abuts on the abutting portion is reduced and a high-grade operational feeling can be provided without using an expensive attenuation damper or the like. Further, the torsion coil spring 25 and the cam shape of the first control cam 71 achieves a function for applying a force for automatically bringing the cover unit 2 to the closing direction when the cover unit 2 is closed near the closed state, so that operability at the time of closing can be improved.

Generally, the end portion 24*b* of the connecting lever 24 abuts on and follows the cam surfaces 71*a* and 71*b* of the first control cam 71 by the urging force of the torsion coil spring 25. However, when a user slams the cover unit 2, inertia forces of the extension tray 23, the connecting lever 24, and the like exceed the urging force of the torsion coil spring 25. In such a case, if the operation unit 7 is located at the position as illustrated in FIGS. 1A and 1B, storage of the extension tray 23 would be too late for closing the cover unit 2, and a part of the extension tray 23 may bump into the bottom of the operation unit 7. In order to prevent such an accident, a second control cam 11*c* is formed in a lower frame 11 as illustrated in FIG. 6C. If the end portion 24*b* of the connecting lever 24 is separated a predetermined distance from the cam surfaces 71*a* and 71*b* of the first control cam 71 when the cover unit 2 is shifted to the closed state, the second control cam 11*c* abuts on the end portion 24*b* of the connecting lever 24. In addition, the second control cam 11*c* guides the connecting lever 24 to a direction for shifting the extension tray 23 to the storage orientation. As described above, the first control cam 71 (i.e., a first cam) guides the connection lever 24 to the direction to which the extension tray protrudes when the cover unit is moved to the opening direction. Further, the second control cam 11*c* (i.e., a second cam) guides the connecting lever 24 to the direction to which the extension tray 23 is stored when the cover unit is moved to the closing direction.

Next, operations of the cover unit 2 when opening and closing are described in detail below with reference to FIGS. 7A to 7D. When a certain printing operation finishes, the motor 41 is controlled to bring the delay storage amount of the delay mechanism 5 into a predetermined amount in preparation for a next printing operation. For example, when the motor 41 has been operated to discharge a sheet, the motor has continued the normal rotation, thus the delay storage amount of the delay mechanism 5 is zero. Thus, when the sheet is discharged and the motor is stopped, the motor 41 is intentionally rotated in the reverse rotation to the predetermined delay storage amount. Then, the printing operation is terminated.

Figure 7A:
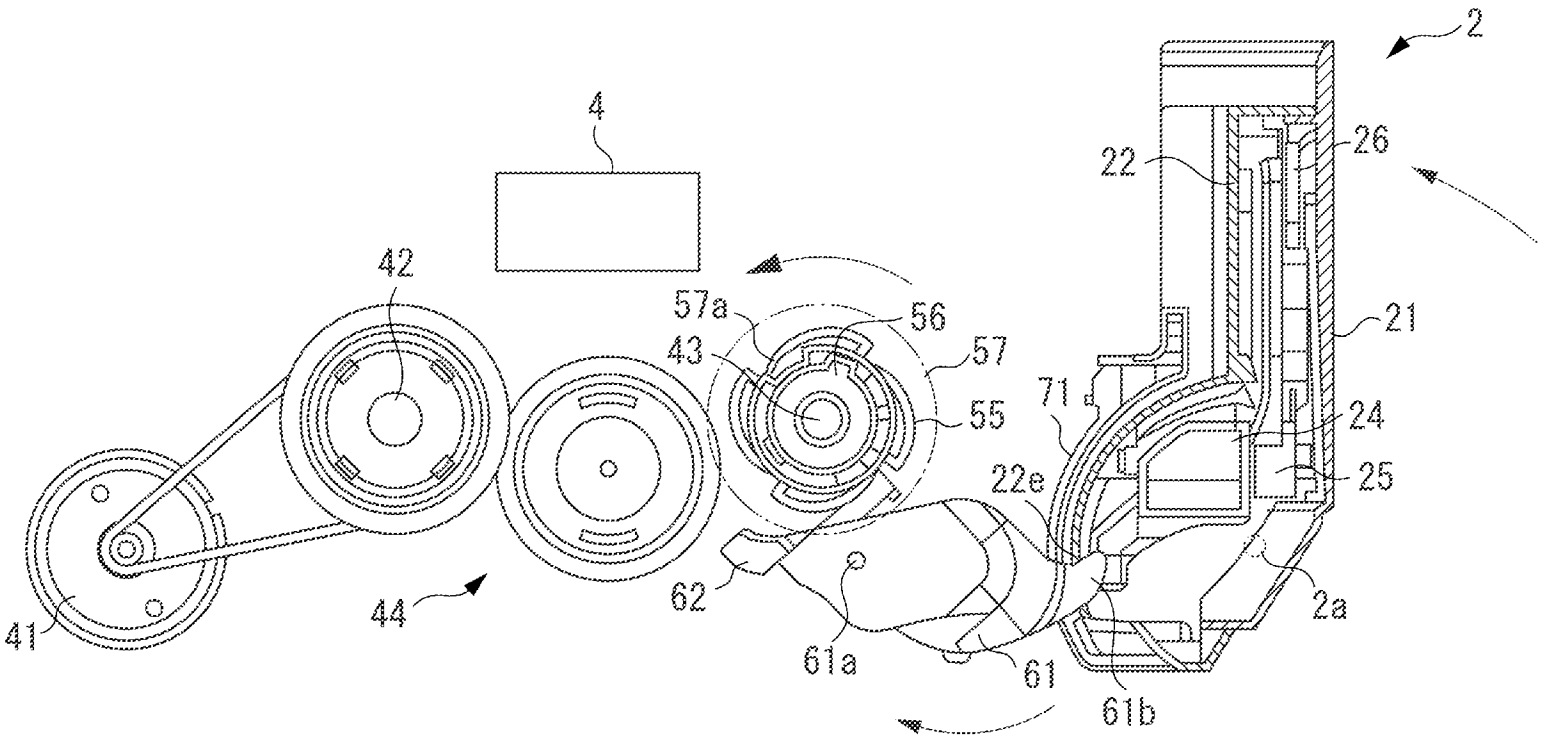
FIGS. 7A to 7D illustrate operations of the cover unit.
Figure 7B:
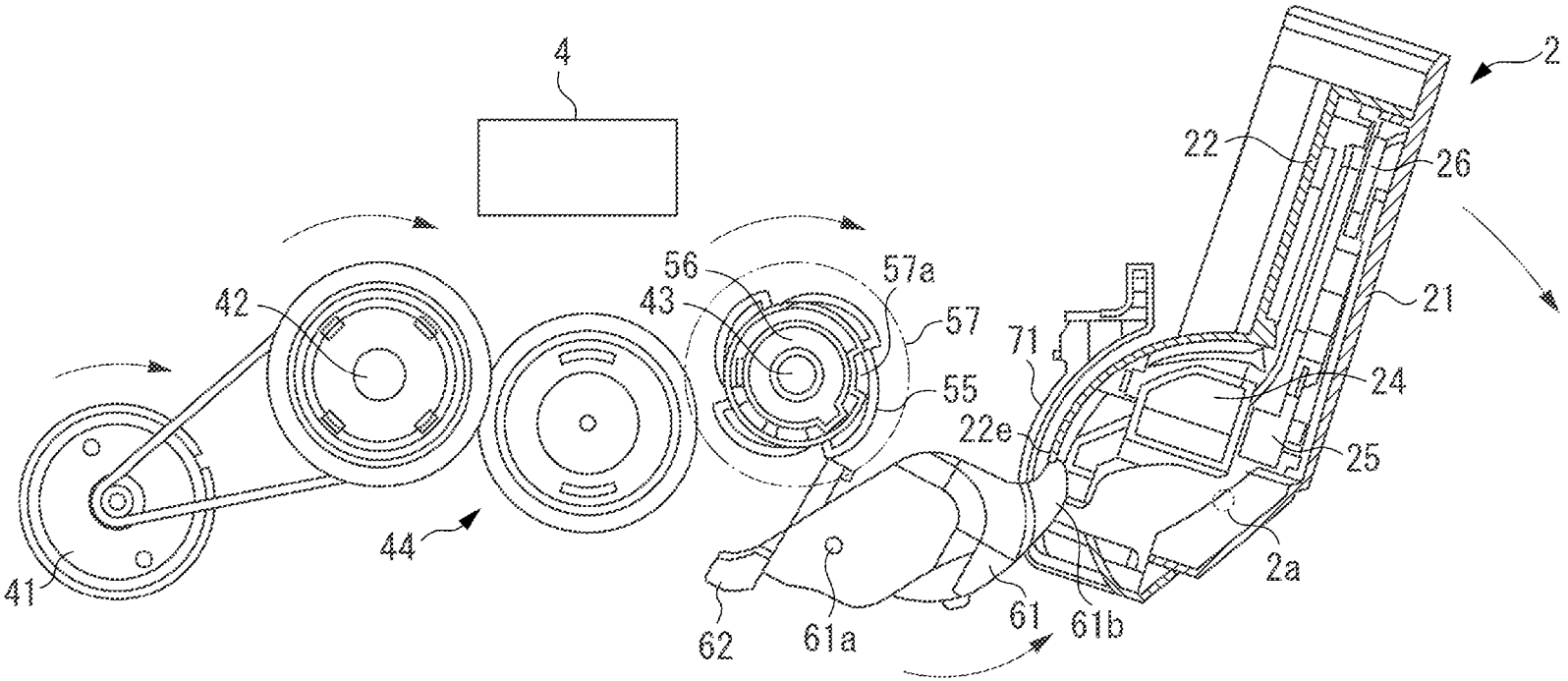

As illustrated in FIG. 7A, if a user closes the cover unit 2 when the printing operation is stopped, the hole end portion 22*e* of the inner cover 22 presses the arm portion 61*b* of the trigger lever 61 to the downward direction to rotate the trigger lever 61, and thus the sub lever 62 at the back is elevated to the connecting position. At that time, in a case where the upper end portion of the sub lever 62 abuts on a curved surface on the outer peripheral cam surface of the trigger cam 55, the upper end portion of the sub lever 62 escapes by rotating to go down. On the other hand, in a case where the upper end portion of the sub lever 62 abuts on the step surfaces 55*c* on the outer peripheral cam surface of the trigger cam 55, the cover unit 2 can be shifted to the complete closed state when the sub lever 62 causes the trigger cam 55 to reversely rotate to consume the delay storage amount. As described above, in order to shift the cover unit 2 to the closed state even if the trigger cam 55 is at a phase to push open the cover unit 2, a releasing mechanism is required. If the delay storage amount of the delay mechanism 5 while the operation is suspended is not zero, there is no need to provide a dedicated releasing mechanism. Accordingly, if the cover unit 2 is closed to near the closed state while the operation is suspended, the cover unit 2 will be in the closed state by being automatically brought to the closing direction by the urging force of the torsion coil spring 25.

Figure 7C:
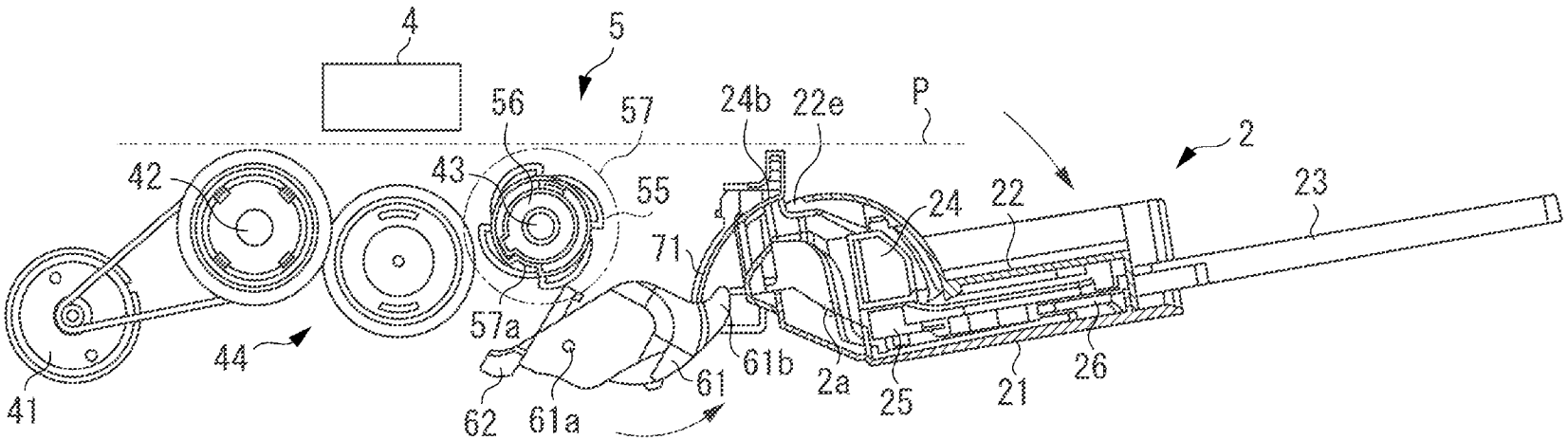

If the printing operation is started when the cover unit 2 is in the closed state, the motor 41 rotates, and the cover unit 2 is automatically opened. The motor 41 normally rotates until the delay storage amount of the delay mechanism 5 becomes zero, and further continues the normal rotation. Then, the step surfaces 55*c* on the outer peripheral cam surface of the trigger cam 55 press the upper end portion of the sub lever 62 to rotate the trigger lever 61, and the arm portion 61*b* is elevated to push up the hole end portion 22*e* of the inner cover 22 in the cover unit 2, thus the cover unit 2 is pushed open to the position illustrated in FIG. 7B. At the position illustrated in FIG. 7B, the self-weight moment in the opening direction is larger than the moment in the closing direction by the urging force of the torsion coil spring 25 of the cover unit 2, so that the orientation of the cover unit 2 is further changed to the opening direction. Next, the cover unit 2 is opened to the open state as illustrated in FIG. 7C while the momentum thereof is reduced by the urging force of the torsion coil spring 25. In conjunction with the movement of the cover unit 2, the extension tray 23 rotates and shifts from the storage orientation to the protruded orientation. At that time, since the trigger lever 61 and the sub lever 62 move to a retracting position illustrated in FIG. 7C in which the back thereof are further weighed down with the self weights, if the trigger cam 55 rotates, the trigger cam 55 does not contact with the sub lever 62.

When the cover unit 2 is in the open state illustrated in FIG. 7C, the conveyance roller 42 and the discharge roller 43 convey a sheet P and the printing unit 4 prints an image on the sheet P. The printed sheet P is discharged from the opening 3 and stored on the sheet stacking surface which is formed by the sheet stacking unit 11*a*, the upper surface of the inner cover 22, and the upper surface of the extension tray 23. When printing of all of a plurality of sheets is finished, the motor 41 is reversely rotates for a predetermined amount to increase the delay storage amount, then the entire printing operation is terminated. Even if a user turns off the power source of the printer, the delay storage amount can be maintained as it is.

It is desirable to avoid the cover unit 2 in the closed state being carelessly opened despite the user's intention on an occasion other than the printing operation such as a recovery operation of the print head. In addition to the recovery operation, the operation other than the printing operation includes, for example, a stand-by operation other than printing, a termination operation after printing, and the like.

Figure 7D:
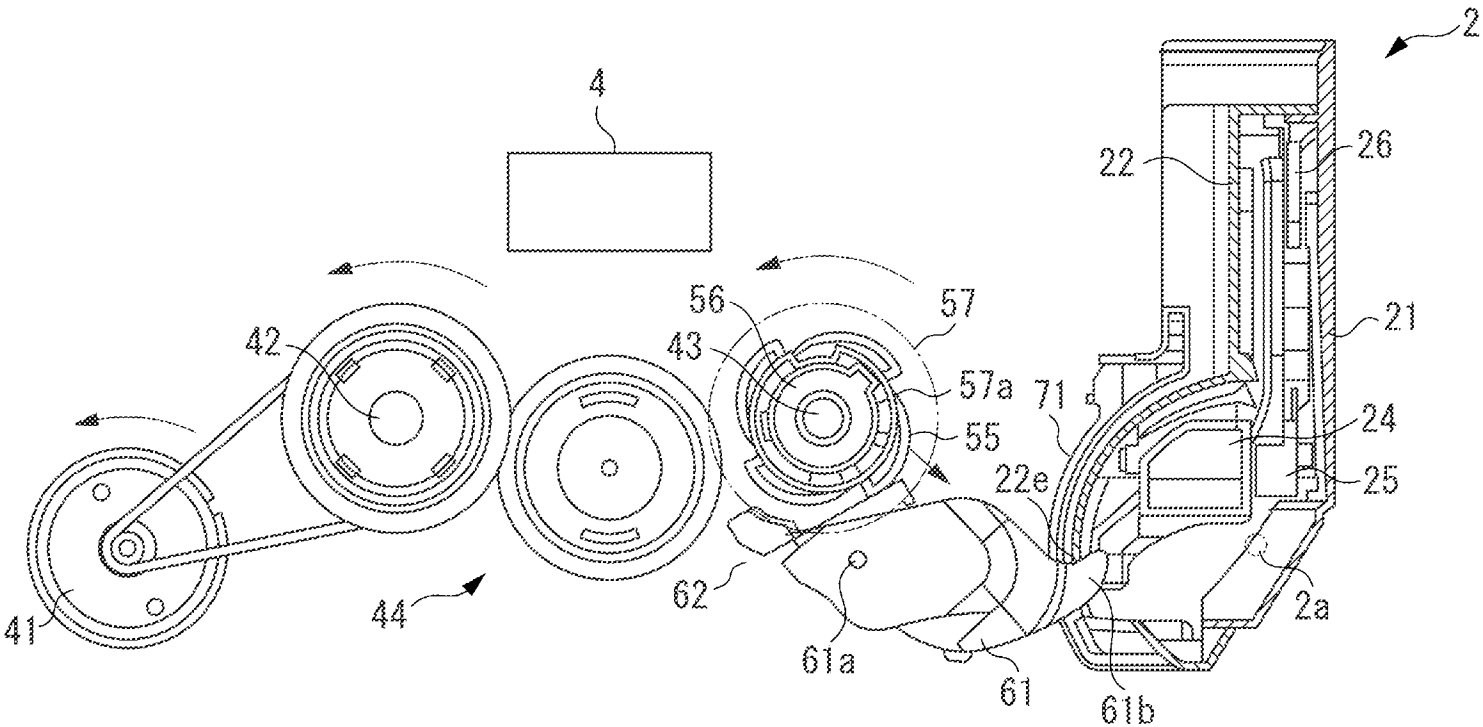

In order to prevent such an accident, as illustrated in FIG. 7D, in a case where the recovery unit is operated when the cover unit 2 is in the closed state, the motor 41 is reversely rotated until the delay storage amount of the delay mechanism 5 will reach the maximum value. When the delay storage amount exceeds four revolutions, i.e., the maximum value, the trigger cam 55 will rotate reversely. However, the upper end portion of the sub lever 62 follows the outer peripheral cam surface of the trigger cam 55 and rotates around the hole portion 61*a* of the trigger lever 61 to escape, the trigger lever 61 does not operate. Then, the motor 41 is normally rotated until the delay storage amount of the delay mechanism 5 reaches a predetermined amount. At that time, the trigger cam 55 and/or the trigger lever 61 will not operate in order not to lose the delay storage amount. As described above, it is controlled to store the delay storage amount of the delay mechanism 5 and then to consume to the predetermined amount, and this operation is repeated if needed. Accordingly, the operation other than the printing operation, such as the recovery operation can be executed while the cover unit 2 is maintained in the closed state so as not to automatically open.

Figure 8A:
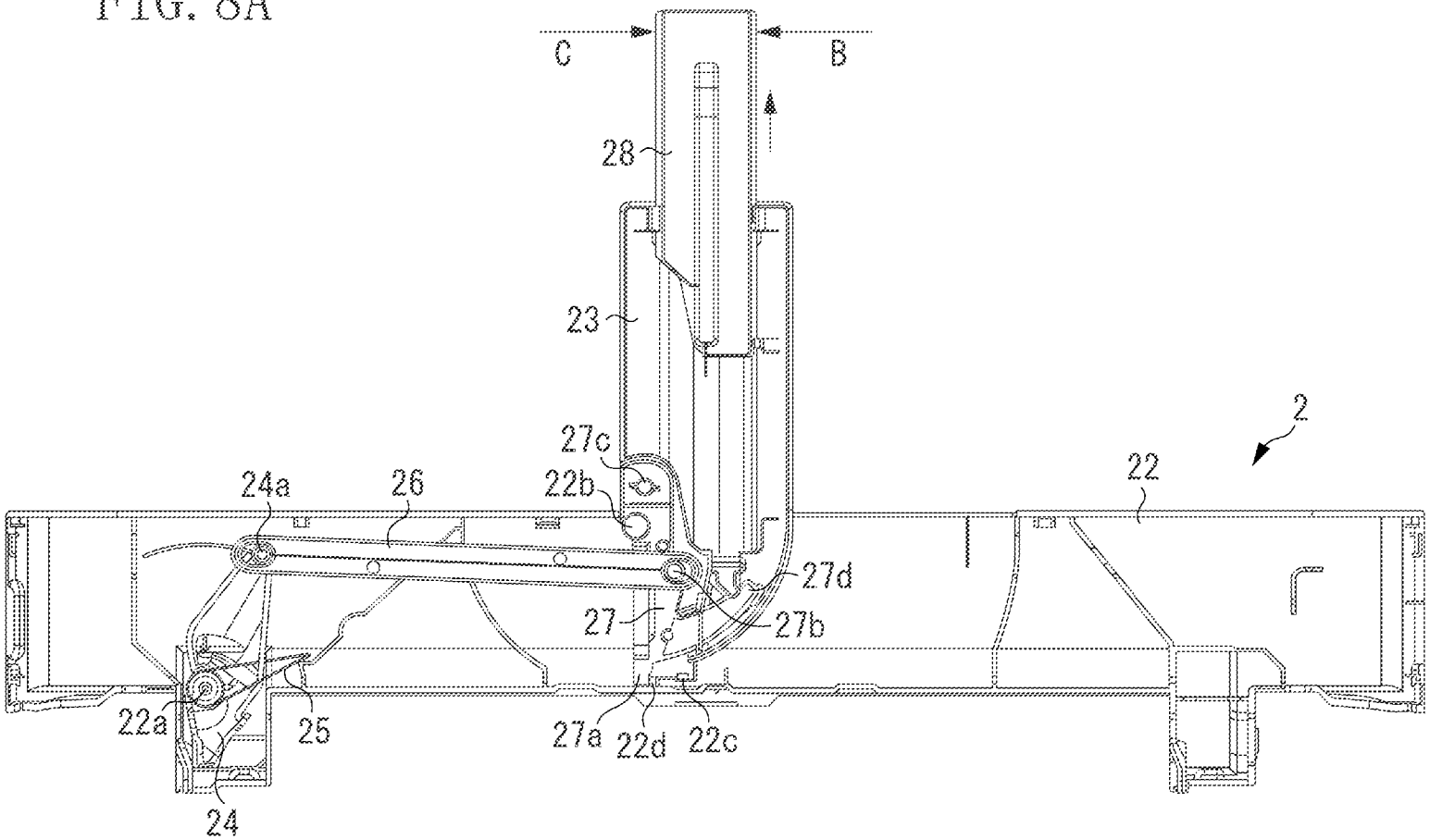
FIGS. 8A to 8C are schematic diagrams illustrating torque limiting operations of an extension tray.
Figure 8B:
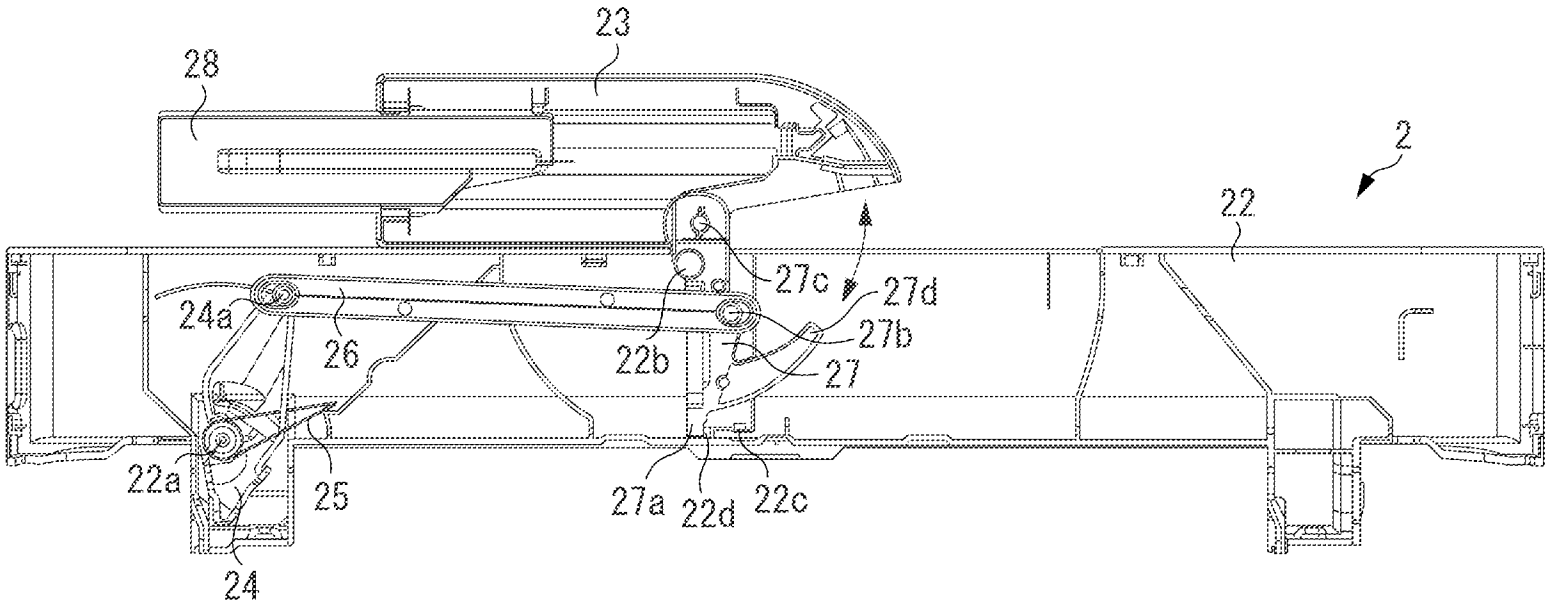
Figure 8C:
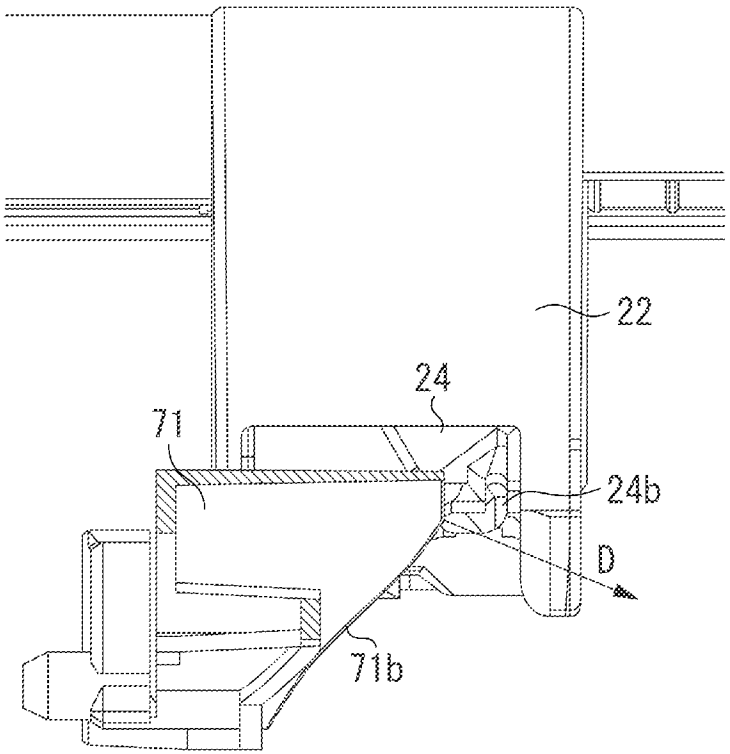

Next, the torque limiting mechanism of the extension tray 23 is described with reference to FIGS. 8A to 8C. The torque limiting mechanism is a mechanism, when the extension tray 23 which is already in a protruded state receives an excessive force to further rotate it, for releasing the force to protect the mechanism itself from breakage. As illustrated in FIG. 8A, if the extension tray 23 or the sub extension tray 28 receives an excessive force over a predetermined value from a direction indicated by an arrow B or an arrow C when the extension tray 23 is in the protruded state, the torque limiting mechanism releases the force to protect the mechanism itself from breakage.

For example, assuming a case that a user applies a great force to the direction indicated by the arrow B which is an opposite direction to the normal rotational direction. In such a case, the engagement of the hook portion 27*d* is released near the shaft member 22*b* of the extension tray 23 by being yielded by the force. Then, a part of the extension tray 23 rotates around a shaft member 27*c* which is different from the shaft member 22*b*, so that the extension tray 23 can escape to a retracting position as illustrated in FIG. 8B. To return the extension tray 23 to the normal state, a user reversely rotates the extension tray 23 around the shaft member 27*c* and returns the engagement of the hook portion 27*d* in place. An engagement force of the hook portion 27*d* acts as a limit value of the torque limiting mechanism, thus the limit value which does not cause breakage of the mechanism will be set.

On the other hand, assuming a case that a user applies a great force to the direction indicated by the arrow C. In such a case, the force is transmitted to the first control cam 71 via the connecting arm 26 and the connecting lever 24 as illustrated in FIG. 8C. When the cover unit 2 approaches the open state, the end portion 24*b* of the connecting lever 24 abuts on the cam surfaces 71*b* of the first control cam 71. When the cover unit 2 reaches the open state, as illustrated in FIG. 8C, the end portion 24*b* of the connecting lever 24 receives a force in a direction indicated by an arrow D since the cam surfaces 71*b* of the first control cam 71 is inclined on which the end portion 24*b* of the connecting lever 24 abuts. The force in the direction of the arrow D generates a moment in the closing direction to the cover unit 2. When the cover unit 2 is near the open state, the force further inclined than the direction of the arrow D is applied and the moment in the closing direction which acts on the cover unit 2 becomes greater. According to such configuration, when the great force acts on the direction of the arrow C, the cover unit 2 is automatically closed and the extension tray 23 rotates to the direction to be stored, so that the force can be released.

According to the above-described present exemplary embodiment, the imaging apparatus includes the mechanism which rotates the extender in conjunction with open and close of the cover unit. According to the mechanism, when the cover unit is opened, the extender rotates and protrudes from the cover unit, and when the cover unit is closed, the extender rotates and is stored in the cover unit. When the cover unit is opened, the extension tray automatically protrudes therefrom, and when a user closes the cover unit, the extension tray is automatically stored in the cover unit. Therefore, the user does not need to take the extension tray in and out, and the imaging apparatus is excellent at the operability. In addition, the extension tray is stored by utilizing the width of the cover unit, thus the size of the extension tray can be easily increased. In other words, the extension tray having the sufficient size can be provided without increasing the size of the cover unit in the height direction and thus the size of the entire apparatus more than necessary. These beneficial features can satisfy both of the improvement of user operability and downsizing of the apparatus.

Further, the interlocking mechanism for rotating the extension tray in conjunction with open and close of the cover unit includes the connecting lever which rotates in association with open and close of the cover unit and the connecting arm for connecting the connecting lever and the extension tray. The mechanism has a simple configuration which is easy to assemble. For example, if the interlocking mechanism is realized by bevel gears or the like, a plurality of components need to be assembled by accurately matching their phases with each other, and it is difficult to improve ease of assembly or downsizing as compared with the mechanism according to the present exemplary embodiment.

Further, the brake mechanism for appropriately applying a brake force to the cover unit when it is opened can make an impact noise when the cover unit is opened small, and the high-grade operational feeling can be provided. At the same time, the brake mechanism can function as a mechanism for automatically bringing the cover unit into the closing direction and holding it when the cover unit is closed near the closed state, thus the operability at the time of closing can also be improved.

Furthermore, by providing an allowance at the connection of the connecting arm, the extender starts rotating with slight delay when the cover unit in the closed state starts moving, therefore, the protruding extender does not bump into the operation unit and the like if these units are positioned above the cover unit.

While the present disclosure has been described with reference to exemplary embodiments, it is to be understood that these embodiments are not limiting. The scope of the following claims is to be accorded the broadest interpretation so as to encompass all such modifications and equivalent structures and functions.

This application claims the benefit of Japanese Patent Application No. 2012-196870 filed Sep. 7, 2012, which is hereby incorporated by reference herein in its entirety.

What is claimed is:

1. An imaging apparatus comprising:

a housing within which an imaging unit is installed;

a door configured to be openable with respect to the housing and to support a sheet used by the imaging unit;

an extender configured to be stored in the door and to support a sheet; and a mechanism configured to rotate the extender in conjunction with opening and closing of the door, wherein the extender rotates and protrudes from the door when the door is opened and the extender rotates and is stored in the door when the door is closed, and wherein the mechanism includes a lever that rotates in conjunction with opening and closing of the door and an arm connecting a part of the lever and a part of the extender.

2. The imaging apparatus according to claim 1, wherein the extender rotates with respect to a rotational shaft which is substantially perpendicular to a supporting surface of the door on which the sheet is supported.

3. The imaging apparatus according to claim 2, further comprising:

a first cam configured to guide the lever to a direction in which the extender protrudes when the door is moved in an opening direction; and a second cam configured to guide the lever to a direction in which the extender is moved to be stored when the door is moved in a closing direction.

4. The imaging apparatus according to claim 2, wherein the mechanism includes a brake mechanism for applying a brake force when the door is opened.

5. The imaging apparatus according to claim 4, wherein the brake mechanism includes a cam for rotating the lever in association with opening and closing of the door and an elastic member for applying a force urging the door in the closing direction via the cam to the lever, applying a force to maintain a closed state in a case where the door is closed, and applying the brake force in a case where the door is opened.

6. The imaging apparatus according to claim 1, wherein the mechanism causes the extender to start rotating with a delay when the door in a closed state starts opening.

7. The imaging apparatus according to claim 1, wherein the door is opened before the imaging unit starts an imaging operation.

8. The imaging apparatus according to claim 7, wherein a roller for conveying a sheet is reversely rotated to transmit a force to open the door.

9. The imaging apparatus according to claim 1, wherein the extender includes a sub extension tray which can be further slid and extended therein.

10. An imaging apparatus comprising:

a housing within which an image unit is installed;

a door configured to be openable with respect to the housing and to support a sheet used by the imaging unit;

an extender configured to be stored in the door and to support a sheet; and a mechanism configured to rotate the extender in conjunction with opening and closing of the door, wherein the extender rotates and protrudes from the door when the door is opened and the extender rotates and is stored in the door when the door is closed, wherein the mechanism includes a torque limiting mechanism configured to, in a case where the extender in a protruded state receives a force for further rotating, release a part of the extender.

11. An apparatus comprising:

a door configured to be openable with respect to a housing;

an extender configured to be stored in the door; and a mechanism configured to link the door and the extender in order to rotate the extender in conjunction with opening and closing of the door, wherein the extender rotates and protrudes from the door when the door is opened and the extender rotates and is stored in the door when the door is closed, wherein the mechanism includes a lever that rotates in conjunction with opening and closing of the door and an arm connecting a part of the lever and a part of the extender.

12. The apparatus according to claim 11, wherein the extender rotates with respect to a rotational shaft which is substantially perpendicular to a surface of the door.

13. The apparatus according to claim 11, wherein the mechanism includes a brake mechanism for applying a brake when the door is opened.

14. An imaging apparatus comprising:

a housing within which an imaging unit is installed;

a door configured to be openable with respect to the housing and to support a sheet for the imaging unit on a surface of the door;

an extender configured to be stored in the door and to support a sheet; and a mechanism configured to rotate the extender with respect to a rotational axis which is substantially perpendicular to the surface in conjunction with opening and closing of the door, wherein the extender rotates and protrudes from the door when the door is opened and the extender rotates and is stored in the door when the door is closed.

15. The imaging apparatus according to claim 14, wherein the mechanism includes a brake mechanism for applying a brake force when the door is opened.

16. The imaging apparatus according to claim 14, wherein the mechanism includes a torque limiting mechanism configured to, in a case where the extender in a protruded state receives a force for further rotating, release a part of the extender.

* * * * *